US009281592B2

(12) United States Patent
Nagamine

(10) Patent No.: US 9,281,592 B2
(45) Date of Patent: Mar. 8, 2016

(54) FEMALE CONNECTOR AND CARD EDGE CONNECTOR

(71) Applicant: J.S.T. Mfg. Co., Ltd., Osaka-shi (JP)

(72) Inventor: Akira Nagamine, Osaka (JP)

(73) Assignee: J.S.T. MFG. CO., LTD., Osaka-shi (JP)

( * ) Notice: Subject to any disclaimer, the term of this patent is extended or adjusted under 35 U.S.C. 154(b) by 0 days.

(21) Appl. No.: 14/224,355

(22) Filed: Mar. 25, 2014

(65) Prior Publication Data

US 2014/0302698 A1 Oct. 9, 2014

(30) Foreign Application Priority Data

Apr. 5, 2013 (JP) ..... 2013-079934

(51) Int. Cl.

| | |
|---|---|
| ***H01R 4/50*** | (2006.01) |
| ***H01R 13/625*** | (2006.01) |
| ***H01R 12/75*** | (2011.01) |
| ***H01R 12/72*** | (2011.01) |

(52) U.S. Cl.

CPC ..... *H01R 12/75* (2013.01); *H01R 12/721* (2013.01)

(58) Field of Classification Search

CPC ..... H01R 13/6275; H01R 13/62933; H01R 23/7068

USPC ..... 439/345, 372, 632, 629

See application file for complete search history.

(56) References Cited

U.S. PATENT DOCUMENTS

| | | | | |
|---|---|---|---|---|
| 5,494,452 | A * | 2/1996 | Matsumoto et al. | 439/358 |
| 6,494,781 | B2 * | 12/2002 | Fujita et al. | 439/635 |
| 6,773,278 | B2 * | 8/2004 | Valasek et al. | 439/157 |
| 7,628,654 | B2 * | 12/2009 | Hori et al. | 439/637 |
| 7,931,502 | B2 * | 4/2011 | Iida et al. | 439/630 |
| 8,187,038 | B2 * | 5/2012 | Kamiya et al. | 439/637 |
| 8,641,438 | B2 * | 2/2014 | Kamiya et al. | 439/260 |
| 2013/0316586 | A1 * | 11/2013 | Nagamine | 439/630 |

FOREIGN PATENT DOCUMENTS

JP 2009-176625 A1 8/2009

* cited by examiner

*Primary Examiner* — Hae Moon Hyeon

(74) *Attorney, Agent, or Firm* — Kratz, Quintos & Hanson, LLP

(57) ABSTRACT

A female connector has a plurality of contacts to be connected to a card member having a card edge portion with a plurality of card edge terminals formed on a substrate, and a housing disposed with contact housing portions, and the housing has a flat opening portion on one side into which the card edge portion is inserted, an insertion port on the other side, and an inner space therein communicating with the flat opening portion and disposed with the card edge portion, and the contact housing portion has at least two stages of first contact housing portions formed on one side relative to the inner space of the housing and communicating with the insertion port, and a stage of second contact housing portions formed on the other side relative to the inner space of the housing and communicating with the insertion port.

15 Claims, 13 Drawing Sheets

11
16
17
17a
17b
18
19
20
21
22
23
V

FIG. 10A
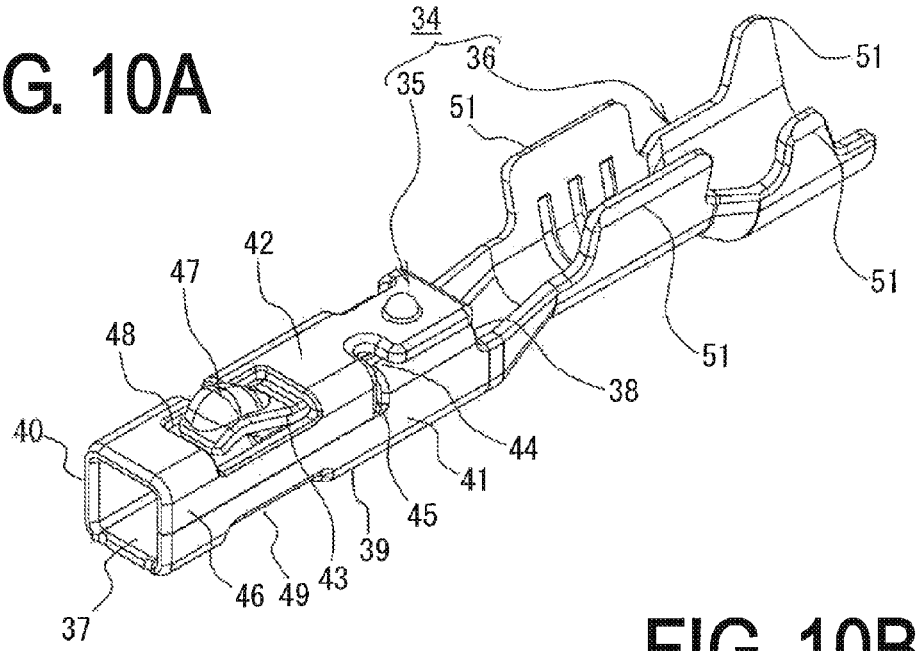
FIG. 10B
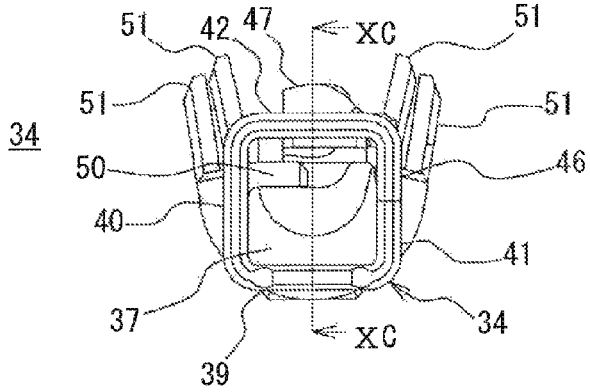
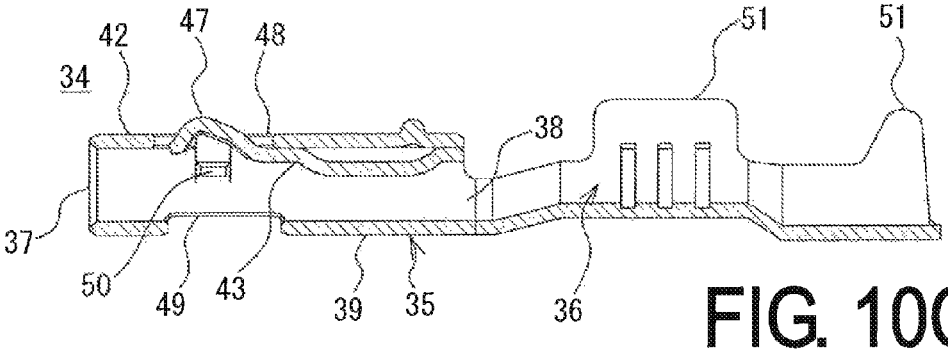
FIG. 10C

FIG. 11A
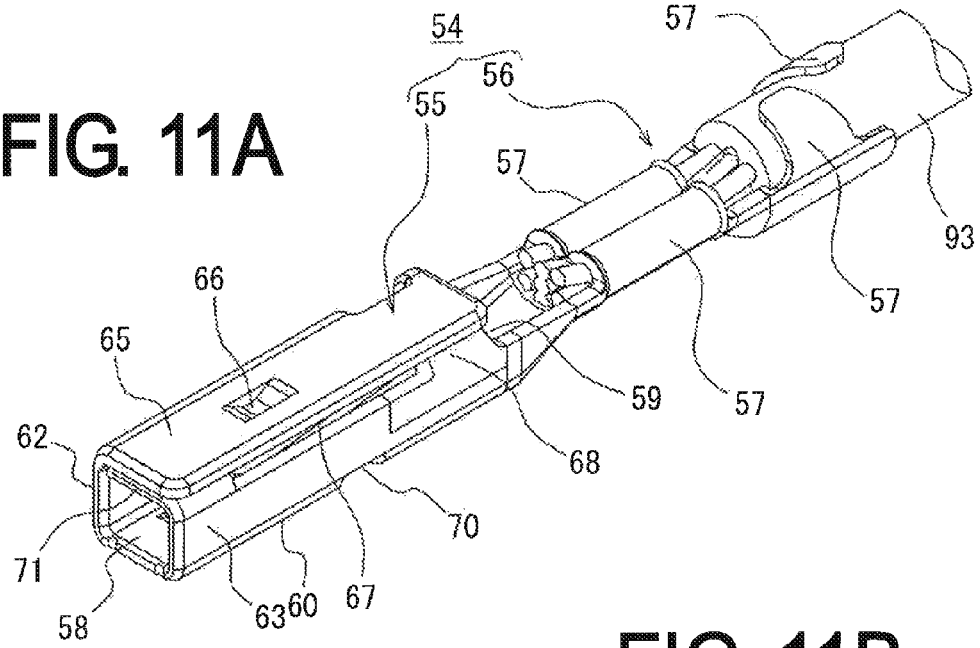
FIG. 11B
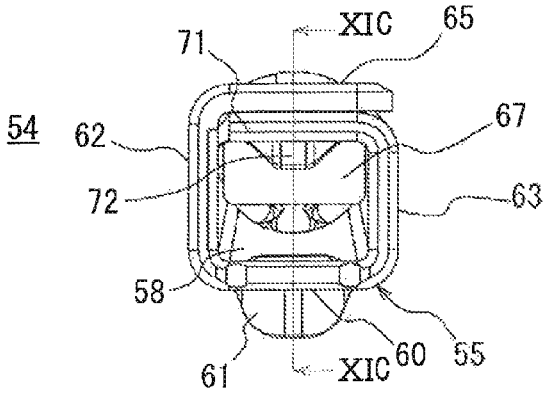
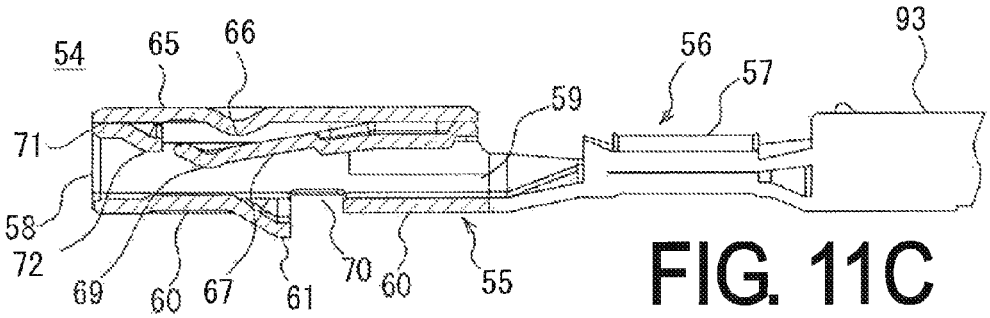
FIG. 11C

FEMALE CONNECTOR AND CARD EDGE CONNECTOR

BACKGROUND OF THE INVENTION

The present invention relates to a female connector and a card edge connector connected to a card member having card edge terminals formed on an end portion of a substrate and particularly to a female connector and a card edge connector connected to a card member having different numbers of contacting terminals between a mounting surface side of a substrate and an opposite side thereof.

A so-called card edge substrate is known that has card edge terminals formed on an end portion of the substrate for directly connecting the substrate and a connector when the substrate with printed electronic circuits etc., is connected to an electronic device etc., and a so-called card edge connector is also known that is formed by combining this card edge substrate etc., with a counterpart female connector.

With regard to card edge connectors, for example, as disclosed in Japanese Laid-Open Patent Publication No. 2009-176625, a card edge connector is known that is arranged with multiple rows of card edge terminals formed on a substrate for narrowing the width of the substrate and that is disposed with multiple stages of contacts of the connector connected to the card edge terminals for the purpose of reduction in size of the connector.

The card edge connector disclosed in Japanese Laid-Open Patent Publication No. 2009-176625 is a card edge connector making electric connection through insertion of an end portion of an electronic substrate between a plurality of contact terminals formed along the insertion direction of the electronic substrate on the same plane of an electronic substrate end portion and a harness drawn to the outside, the card edge connector including a housing having an electric substrate insertion hole in which the end portion of the electric substrate is inserted, first and second contact conductors arranged in the electric substrate insertion hole in the housing and respectively coming into contact with leading contact terminals located at the head of the insertion direction and inner contact terminals located on the inner side of the substrate as compared to the leading contact terminals when the end portion of the electric substrate is inserted, an auxiliary contact conductor disposed in the housing at a height position more away from the surface of the electric substrate than the first contact conductor in the direction perpendicular to a plane on which the plurality of the contact terminals of the electric substrate is formed, and a coupling conductor disposed in the housing and having one end connected to the second contact conductor and the other end in contact with the auxiliary contact conductor, and the harness is connected to the first contact conductor and the auxiliary contact conductor.

With such a configuration of the card edge connector disclosed in Japanese Laid-Open Patent Publication No. 2009-176625, even if the leading contact terminals and the inner contact terminals are formed along the insertion direction of the electric substrate, the first contact conductor and the auxiliary contact conductor electrically connected to the respective terminals can be disposed on multiple stages at a sufficient interval in the direction perpendicular to the electric substrate surface.

The card edge connector is used in various applications and is used in, for example, an electronic control device of an automobile etc. The electronic control device is provided with power circuits allowing the electronic control device to operate and signal circuits inputting and outputting signals. Although having different electric ratings, the power circuits and the signal circuits are arranged on a substrate in a mixed manner. Since the power circuits generate heat due to energization, the absence of efficient cooling may cause a trouble in another signal circuit or electric components mounted on the substrate.

It is thus contemplated that the signal circuits and the power circuits arranged on the substrate are separately arranged on a top surface and a back surface of the substrate to dispose a cooling member on the side disposed with the power circuits. As a result of such an arrangement, since the signal circuits become dense and has a larger number of card edge terminals as compared to the power circuits, a difference is generated between the numbers of the card edge terminals formed on the top surface and the back surface of the substrate.

If the signal circuits and the power circuits arranged on the substrate are separately arranged on the top surface and the back surface of the substrate, since the contacts to be connected to the card edge terminals are disposed symmetrically relative to the substrate in the card edge connector disclosed in Japanese Laid-Open Patent Publication No. 2009-176625, contacts and a space provided with the contacts are wasted on either one side. Since the substrate is located at the center of the housing, efficient cooling may become difficult because of obstacles such as cooling members disposed on the power circuit sides of one and the other sides.

SUMMARY OF THE INVENTION

It is therefore an object of the present invention to provide a female connector and a card edge connector including multiple stages of contacts on one side and a stage of contacts on the other side to achieve asymmetry structure across an inserted substrate so as to enable connection to a substrate having the numbers of formed card edge terminals different between the top surface and the back surface.

To solve the problem, a female connector of a first aspect of the present invention is a female connector comprising a housing disposed with a plurality of contacts to be connected to a card member having a card edge portion with a plurality of card edge terminals formed on a substrate, and contact housing portions housing the contacts, the housing having a flat opening portion into which the card edge portion is inserted on one side, an insertion port through which a wire is inserted on the other side, and an inner space therein, the inner space communicating with the flat opening portion and acting as a portion in which the card edge portion is located, the contact housing portion having at least two stages of first contact housing portions formed on one side relative to the inner space of the housing, the first contact housing portions communicating with the insertion port, and a stage of second contact housing portions formed on the other side relative to the inner space of the housing, the second contact housing portions communicating with the insertion port.

A female connector of a second aspect is the female connector of the first aspect, wherein the first contact housing portions are formed on three stages.

A female connector of a third aspect is the female connector of the first aspect, wherein the first contact housing portions are made up of inner contact housing portions disposed adjacently to the inner space and at least one stage of outer contact housing portions disposed on the outside of the inner contact housing portions, the second contact housing portions are made up of inner contact housing portions disposed adjacently to the inner space, the respective inner contact housing portions of the first contact housing portions and the second contact housing portions are disposed oppositely to each other, the inner contact housing portions house first contacts to be directly connected to the card edger terminals while the outer contact housing portions house second contacts, the second contacts are coupled to relay terminals made of conductive material, and the relay terminals are extended in the inner space to be connected to the card edge terminals.

A female connector of a fourth aspect is the female connector of the third aspect, wherein the housing has relay terminal housing portions formed to be in communication with the outer contact housing portions, and the relay terminal housing portions house the relay terminals.

A female connector of a fifth aspect is the female connector of the first aspect, wherein the housing has at least one rib formed to link the upper side and the lower side of the inner space.

A female connector of a sixth aspect is the female connector of the third aspect, wherein the housing is mounted with a lid body covering the relay terminals and having an opening at least at a portion corresponding to the flat opening portion, and the lid body has a pressing portion pressing, positioning, and fixing a portion of the relay terminals.

A female connector of a seventh aspect is the female connector of the fourth aspect, wherein the housing is divided into a contact housing on the side disposed with the contact housing portions and a relay terminal housing on the side disposed with the relay terminal housing portions, and the contact housing and the relay terminal housing are detachably connected.

A female connector of an eighth aspect is the female connector of the seventh aspect, wherein the first contact has a first connecting portion connected to the card edge terminal on one side formed integrally with a first wire mounting portion mounted with the wire on the other side, the first connecting portion is formed into a hollow cylindrical body having a first front-side opening formed on the inner space side of the contact housing when the first contact is attached to the inner contact housing portion, a first rear-side opening formed on the first wire mounting portion side, and a first contacting portion brought into contact with the card edge terminal, the inner contact housing portion of the contact housing is covered by side wall portions formed on the sides of both side surfaces of the housed first contact and an end wall portion formed on the first front-side opening side, the first contact is opened at least at a portion provided with the first contacting portion, and a protruding portion fitted into the first front-side opening of the first connecting portion is formed on the side of the end wall portion opposite to the first contact.

A female connector of a ninth aspect is the female connector of the eighth aspect, wherein the end wall portions formed in the contact housing are formed to be respectively integrally linked on one side and the other side across the inner space of the contact housing.

A female connector of a tenth aspect is the female connector of the seventh aspect, wherein the second contact has on one side a coupling portion to which the relay terminal is inserted and couple and formed integrally with a second wire mounting portion to be mounted with the wire on the other side, the coupling portion formed into a hollow cylindrical body having a second front-side opening formed on the flat opening portion side when the second contact is attached to the relay terminal housing, and a second rear-side opening formed on the second wire mounting portion side, and a second contacting portion is disposed inside the coupling portion and brought into contact with a portion of the relay terminal when the relay terminal is coupled.

A female connector of an eleventh aspect is the female connector of the third aspect, wherein the relay terminal has a relay terminal main body made up of a bent plate-like body, a second connecting portion formed on one side of the relay terminal main body and connected to the card edge terminal, and a coupling piece inserted from the second front-side opening of the coupling portion which is formed on the other side of the relay terminal main body, coupled in the coupling portion of the second contact, and brought into contact with the second contacting portion in the coupling portion.

A card edge connector of a twelfth aspect is a card edge connector comprising the card member to be connected to the female connector including: a housing disposed with a plurality of contacts to be connected to a card member having a card edge portion with a plurality of card edge terminals formed on a substrate, and contact housing portions housing the contacts; the housing having a flat opening portion into which the card edge portion is inserted on one side, an insertion port through which a wire is inserted on the other side, and an inner space therein, the inner space communicating with the flat opening portion and acting as a portion in which the card edge portion is located; the contact housing portion having at least two stages of first contact housing portions formed on one side relative to the inner space of the housing, the first contact housing portions communicating with the insertion port, and a stage of second contact housing portions formed on the other side relative to the inner space of the housing, the second contact housing portions communicating with the insertion port; and the substrate having at least two rows of card edge terminals on one surface of the substrate and one row of card edge terminals on the other surface thereof, the card edge portion having a slit disposed at least at one location.

A card edge connector of a thirteenth aspect is the card edge connector of the twelfth aspect, wherein the card member includes a card housing to be connected to the housing of the female connector, the card housing has a substrate insertion hole formed at a position corresponding to the flat opening portion of the female connector, and the card edge portion of the card member is projected from the substrate insertion hole.

A card edge connector of a fourteenth aspect is the card edge connector of the twelfth aspect, wherein the card housing is disposed with an annular fitting portion covering the projected card edge portion.

A card edge connector of a fifteenth aspect is the card edge connector of the twelfth aspect, wherein the substrate of the card member has a mounting portion mounted on one side and has a power source wiring for a power source disposed on the other side, and a cooling member is disposed on the side disposed with the power source wiring.

A card edge connector of a sixteenth aspect is the card edge connector of the twelfth aspect, wherein the female connector is disposed with a lock mechanism fixing the state of connection to the card housing.

EFFECTS OF THE INVENTION

The female connector of the first and second aspects is disposed with multiple stages, for example, three stages, of contacts on one side relative to the inner space in which the card member is located and a stage of contacts on the other side to make the arrangement of the contacts asymmetric. By making the configuration of the female connector asymmetric, for example, multiple circuit wirings for signals can be formed on a mounting surface on one side of the substrate while only the circuit wiring for a power source can be disposed on the other side of the substrate. As a result, since the other side of the substrate can be formed thinner, a heat sink etc., for cooling can be disposed on the side with the circuit wiring for a power source. Therefore, the female connector of the first aspect enables usage of the card member with the space of the substrate efficiently utilized.

When the multiple circuit wirings for signals are formed on the mounting surface on one side of the substrate and only the circuit wiring for a power source is disposed on the other side of the substrate in the female connector of the third aspect, the circuit wirings for signals can be connected to multiple stages of the first contacts and the relay terminals coupled to the second contacts disposed on one side of the female connector and the circuit wiring for a power source can be connected to a stage of the first contacts disposed on the other side of the female connector. Therefore, the female connector of the second aspect enables smooth efficient connection to the card member with the space of the substrate efficiently utilized.

According to the female connector of the fourth aspect, since the relay terminals can be fixed at the correct positions of the housing and the relay terminals can be restrained from moving due to an external force, the relay terminals can correctly be connected to the card edge terminals at predetermined positions.

According to the female connector of the fifth aspect, since the rib formed in the inner space of the housing integrates the inner space of the housing, the inner space can be restrained form expanding outward, and deformation of the housing and deterioration in contact pressure due to the deformation can be suppressed. A wide female connector can be supported by disposing a plurality of the ribs. These ribs act as portions to which slits disposed in the substrate of the card members are fitted.

According to the female connector of the sixth aspect, since the relay terminals are covered by the lid body, application of an external force is suppressed and the relay terminals can be prevented from coming off. The pressing portion of the lid body can press the relay terminals for prevention of coming off etc., and can restrain reduction in contact pressure.

According to the female connector of the seventh aspect, since the housing is divided, the housing having a complicated shape can easily be formed.

According to the female connector of the eighth aspect, the first contact housed in the inner contact housing portion is surrounded by the side wall portions and the end wall portion formed integrally with the contact housing, and the end wall portions formed side-by-side in the width direction are integrally and firmly formed. Since the projecting portion formed on the end wall portion is fit into the first front-side opening formed in the first contact, the first contact can firmly be fixed to the contact housing and, since the first contact is fixed, the contact pressure can be maintained during connection to the card member.

According to the female connector of the ninth aspect, since the housing can firmly be formed, the contacts can be restrained from moving in the contact housing portions and the contact pressure can be maintained.

According to the female connector of the tenth aspect, since one plate-like body is bent to integrally form the coupling portion and the second wire mounting portion of the second contact and to form the second contacting portion brought into contact with a portion of the relay terminal on the outside of the coupling portion coupled to the relay terminal, the second contact can efficiently be formed.

According to the female connector of the eleventh aspect, since the relay terminal is formed by bending one elongated flat plate-like body, the relay terminal has an elastic force and can certainly be connected to the card edge terminal while a high contact pressure can be acquired.

According to the card edge connector of the twelfth aspect, the card edge connector can be acquired that produces the effect of the female connector of any one of the first to eleventh aspects. Since the slit formed in the substrate and the rib formed in the housing of the female connector are disposed in a corresponding manner and are fitted to each other at the time of connection, the positioning can be achieved and the contacts and the relay terminals can certainly be connected to the card edge terminals.

According to the card edge connector of the thirteenth aspect, since the card member is disposed with the card housing, the female connector can certainly be connected and can be made hard to come off.

According to the card edge connector of the fourteenth aspect, the fitting portion can be formed on the card housing to protect the card edge portion from an external force. When the card member is connected to the female connector, the housing of the female connector and the fitting portion of the card housing can be fit to each other to achieve the connection without a gap. By disposing an elastic member such as a packing between the housing of the female connector and the fitting portion of the card housing, the waterproof property can be improved.

According to the card edge connector of the fifteenth aspect, since only the power wiring for a power source is disposed on either one side of the card member, the power wiring side can be formed thinner and the space of the card member can efficiently be utilized. Since the side disposed with the power wiring is formed thinner, a cooling member such as a heat sink cooling the card member can be disposed, for example.

According to the card edge connector of the sixteenth aspect, the lock mechanism can be disposed to restrain the female connector and the card member from being disconnected.

BRIEF DESCRIPTION OF THE DRAWINGS

FIG. 10A is a perspective view of a first contact; FIG. 10B is a front view of the first contact; FIG. 10C is a cross-sectional view taken along a line XC-XC of FIG. 10B;

FIG. 11A is a perspective view of a second contact; FIG. 11B is a front view of the second contact; FIG. 11C is a cross-sectional view taken along a line XIC-XIC of FIG. 11B;

DESCRIPTION OF THE PREFERRED EMBODIMENTS

Preferred embodiments of the present invention will now be described with reference to the drawings. The following embodiments are mere exemplifications of a female connector and a card edge connector for embodying a technical concept of the present invention and are not intended to limit the present invention thereto. The present invention is equally applicable to other embodiments included in claims.

Figure 1:
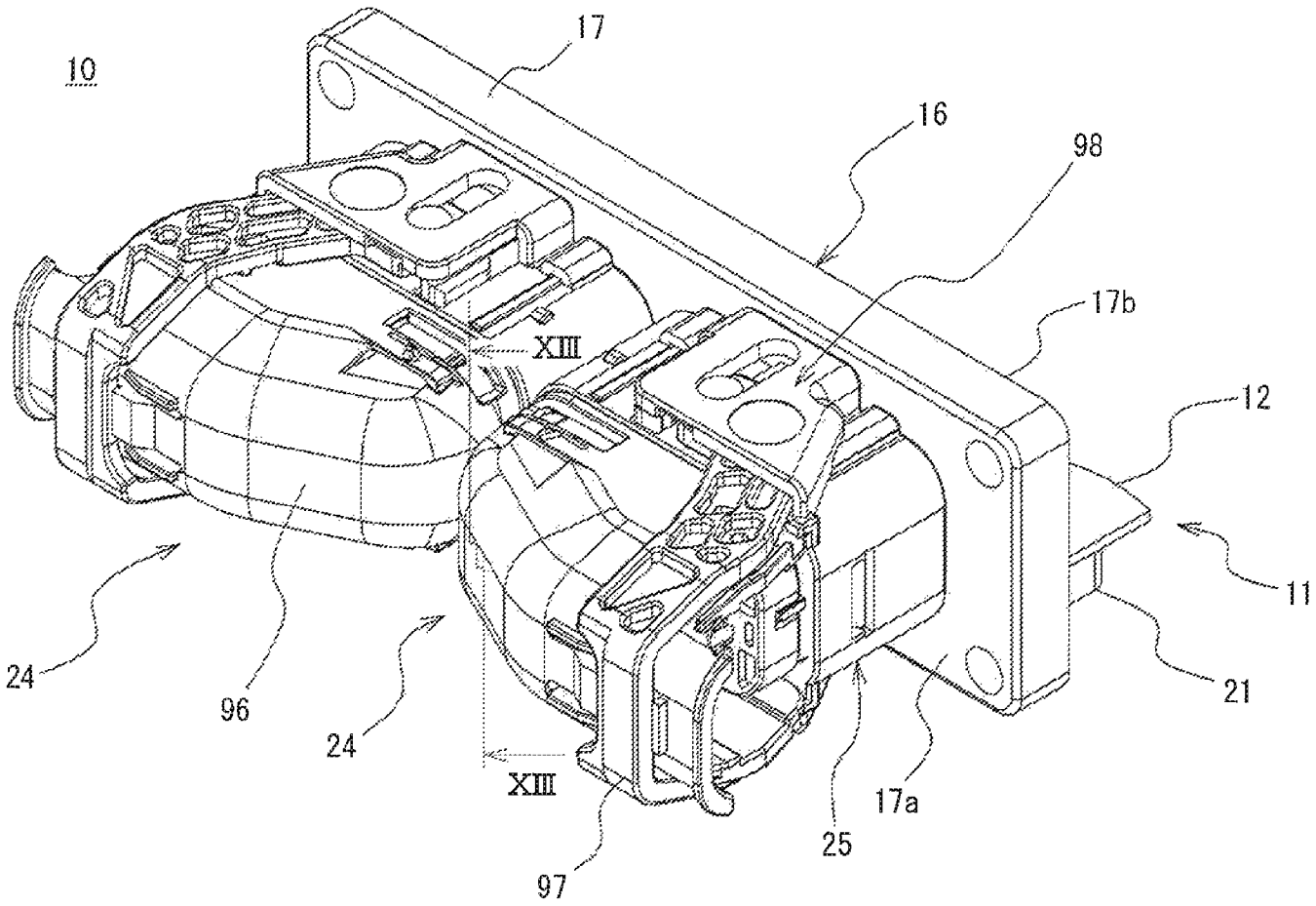
FIG. 1 is a perspective view of a card edge connector of an embodiment.

A card edge connector 10 according to an embodiment will be described with reference to FIGS. 1 to 13. The card edge connector 10 of the embodiment is made up of a card member 11 and a female connector 24 to which the card member 11 is connected, as depicted in FIG. 1. A card housing 16 is attached to the card member 11 of FIG. 1.

Figure 2:
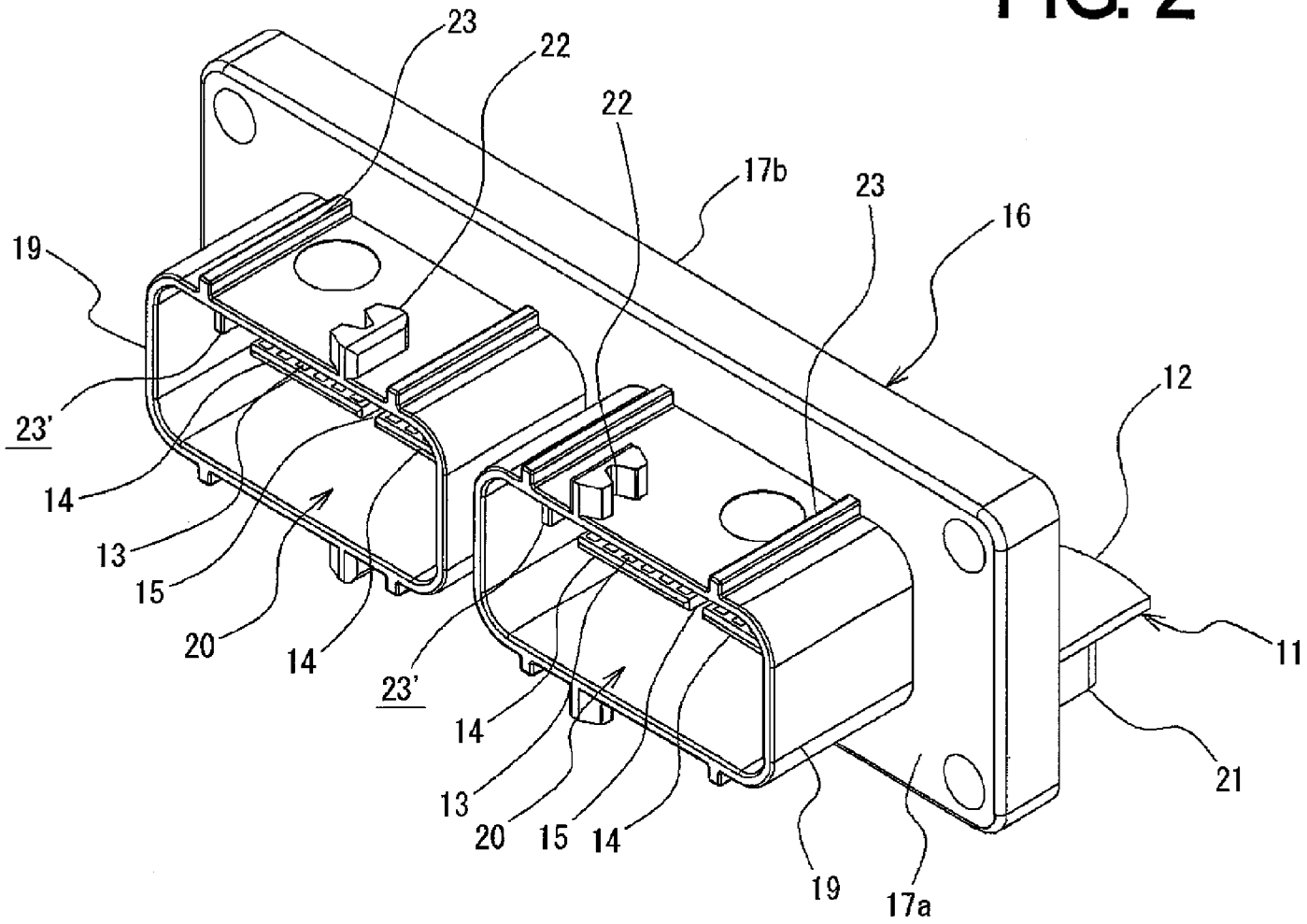
FIG. 2 is a perspective view of a card member disposed with a card housing of the embodiment.
Figure 3A:
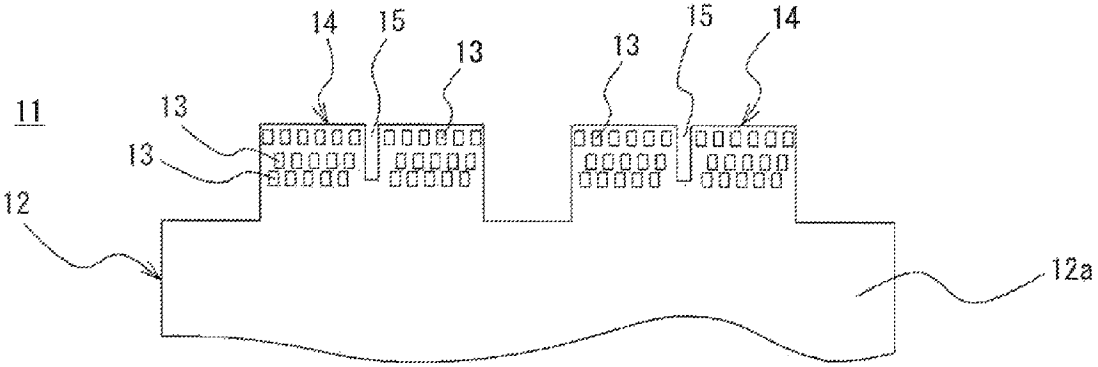
FIG. 3A is a plane view of a top surface of a substrate of the card member of the embodiment.
Figure 3B:
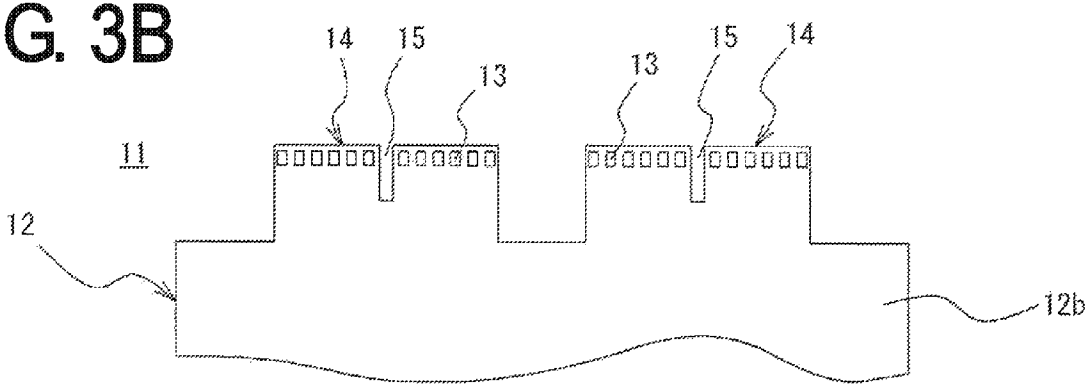
FIG. 3B is a plane view of a back surface of the substrate.

The card member 11 of the embodiment will be described with reference to FIGS. 1 to 5. The card member 11 is made up of a substrate 12 disposed with circuit wiring etc., (not depicted) and having a card edge portion 14 having in one and the other end portions a plurality of card edge terminals 13 formed to be connected to a plurality of contacts 33 included in the female connector 24, and the card housing 16 attached to the substrate 12. As depicted in FIG. 1, the card member 11 of the embodiment is configured to be connected with the two female connectors 24 and, therefore, as depicted in FIGS. 3A and 3B, the card edge portion 14 is depicted as being divided into two sections. The card edge portion may have not only two sections but also only one section or three or more sections.

The substrate 12 has components such as integrated circuits and capacitors mounted to form a signal circuit on a top surface 12*a* and to form a power circuit on a back surface 12*b* (not depicted). Since the signal circuit is formed and a large number of signals are exchanged, the top surface 12*a* has a large number of the card edge terminals 13 of the card edge portion 14 and three rows of the card edge terminals 13 are formed as depicted in FIGS. 3A and 3B. The three rows are arranged toward the direction of connection of the substrate 12 with the female connector 24 so as to avoid overlap with each other (see FIG. 3A). As a result, when the card member 11 and the female connector 24 are connected, the contacts 33 and relay terminals 85 irrelevant to the connection are restrained from moving on and damaging the card edge terminals 13.

On the other hand, since only the power circuit is formed on the back surface 12*b*, a small number of the card edge terminals 13 of the card edge portion 14 are formed in a row. As described above, the numbers of the card edge terminals 13 of the card edge portion 14 are asymmetric on the substrate 12 of the embodiment. The card edge portion 14 of the substrate 12 has a slit 15 of a predetermined length formed in a center portion.

Figures 4A, 4B, 4C, 4D, 4E, 4F:
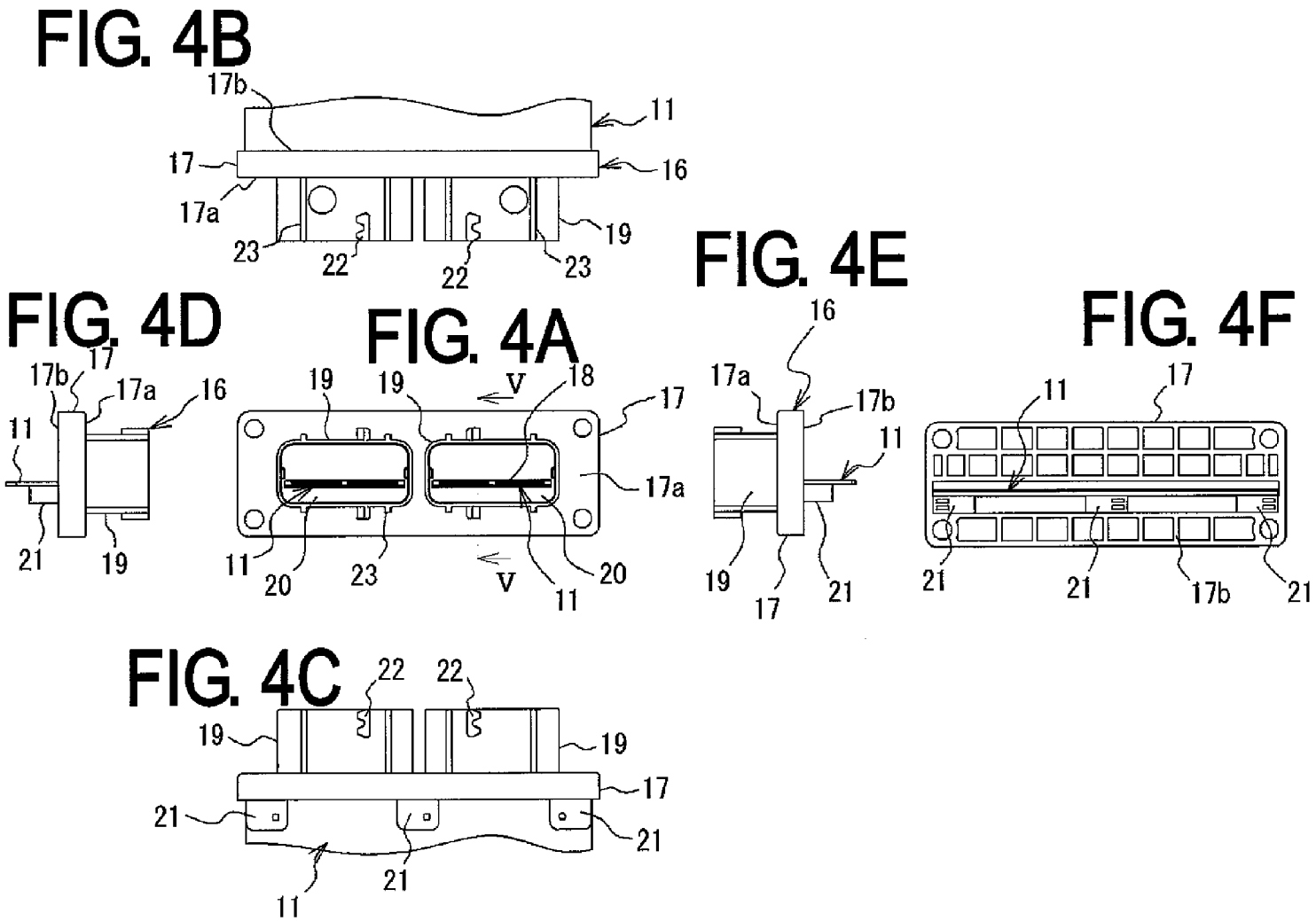
FIG. 4A is a front view of the card member disposed with the card housing.
FIG. 4B is a top view.
FIG. 4C is a bottom view.
FIG. 4D is a side view of one side.
FIG. 4E is a side view of the other side.
FIG. 4F is a rear view.
Figure 5:
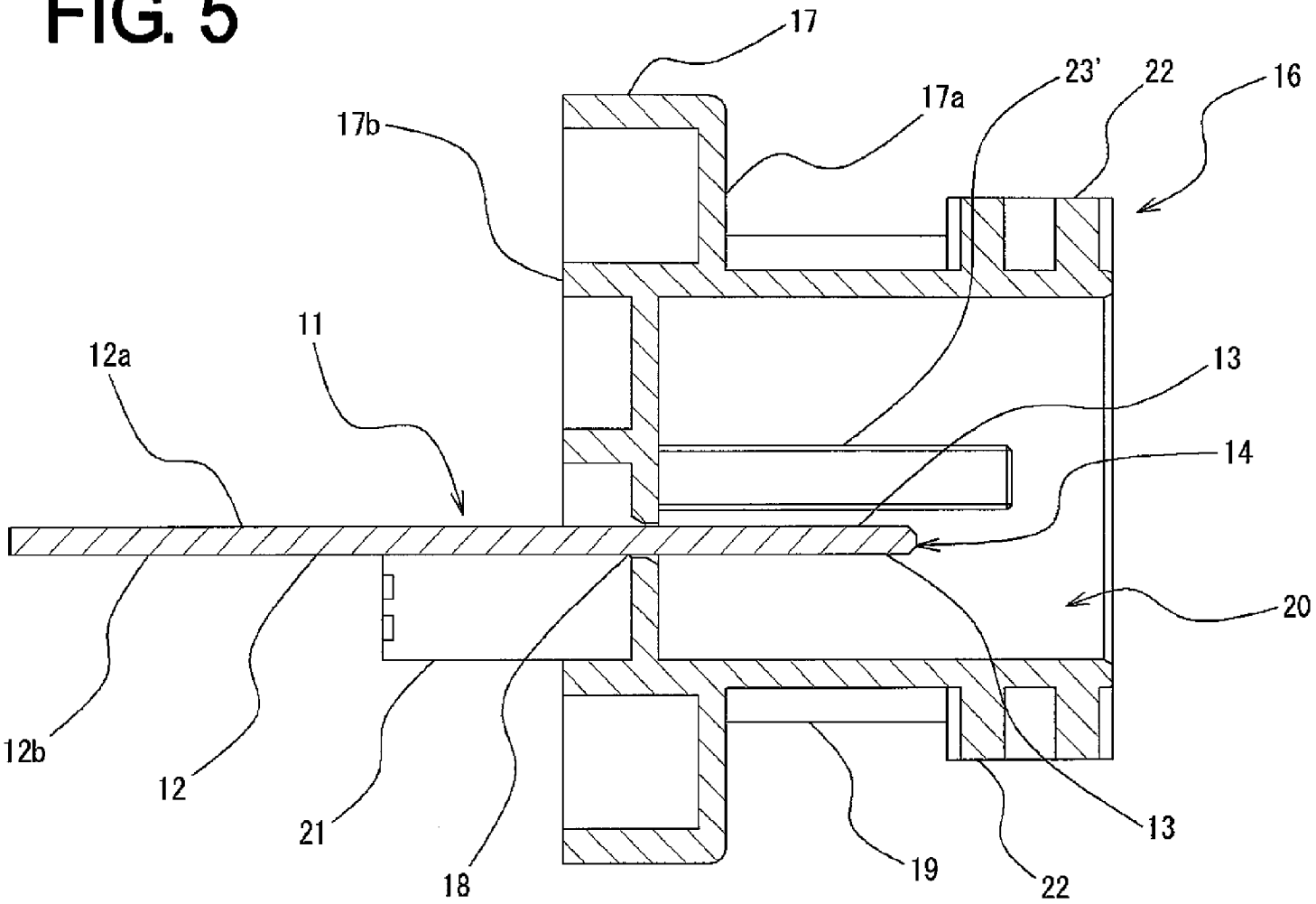
FIG. 5 is a cross-sectional view taken along a line V-V of FIG. 4A.

The card housing 16 fixes the substrate 12 and is connected to a housing 25 of the female connector 24. As depicted in FIGS. 2, 4, and 5, the card housing 16 is made up of a frame portion 17 disposed perpendicularly to the substrate 12, a substrate insertion hole 18 formed in the frame portion 17 for insertion of the card edge portion 14 of the substrate 12, a fixing portion 21 fixing the substrate 12 to the frame portion 17, and a fitting portion 19 covering the inserted card edge portion 14. The frame portion 17, the fixing portion 21, and the fitting portion 19 are integrally formed.

The frame portion 17 is formed into a rectangular plate-like body having a predetermined thickness and it is assumed that a front surface 17*a* is on the side connected with the female connector 24 while a rear surface 17*b* is on the side disposed with the substrate 12. Since the frame portion 17 is disposed, the female connector 24 and the card member 11 can be restrained from swinging when the female connector 24 is connected to the card member 11 because the frame portion 17 abuts on a connection-side surface of the housing 25 of the female connector 24.

The frame portion 17 has the substrate insertion hole 18 opened for insertion of the card edge portion 14 of the card member 11. The substrate insertion hole 18 is formed into a size allowing insertion of the thickness of the substrate 12 and the width of the card edge portion 14. Although the two substrate insertion holes 18 are disposed since the card edge portion 14 is formed into two sections in the embodiment, the substrate insertion hole 18 can be formed in accordance with the configuration of the substrate 12 of the counterpart card member 11. Since the substrate insertion hole 18 is formed slightly lower than the center of the frame portion 17, the card member 11 is disposed slightly lower than a center portion of the frame portion 17.

The rear surface 17*b* of the frame portion 17 is disposed with the fixing portion 21 for fixing the inserted substrate 12. The fixing portion 21 is projected to support the rear surface 17*b* side of the substrate 12 and the substrate is fixed to the fixing portion 21 with a fixing means such as a screw.

The front surface 17*a* of the frame portion 17 has the fitting portion 19 annularly extended to cover the inserted card edge portion 14 of the card member 11 and opened on one side. The fitting portion 19 is a portion fitted to the housing 25 of the female connector 24 at the time of connection with the female connector 24. The inside of the fitting portion 19 is provided with a space 20 in which the inserted cart edge portion 14 is located and connected to the female connector 24. The fitting portion 19 is extended longer than the inserted card edge portion 14.

An outer circumference of the fitting portion 19 is disposed with a guide 23 guiding the housing 25 of the female connector 24 at the time of connection with the female connector 24 and a lock portion 22 engaged with a lock mechanism 98 disposed on the female connector 24. An inner surface of the fitting portion 19 is also formed to have a guide portion 23' guiding the housing 25 of the female connector 24 at the time of connection with the female connector 24.

The card housing may be disposed with a case member covering the substrate. In this case, the case member may be formed as a separate member detachable from the frame portion of may be formed integrally with the frame portion etc.

The female connector 24 will be described with reference to FIGS. 6 to 12B. Although the card edge connector 10 of the embodiment is disposed with the two female connectors 24, these female connectors 24 have the common configuration except that a portion of the configuration is symmetrically formed and, therefore, only one of the female connectors 24 will representatively be described.

As depicted in FIGS. 7A to 9, the female connector 24 has the housing 25 in which a plurality of contact housing portions 31 is formed, contacts 33 housed in the contact housing portions 31, and relay terminals 85 connected to a portion of the contacts 33. A lid body 90 covering the relay terminals 85 is attached to the housing 25 on the side connected to the relay terminals 85. The contacts 33 are connected to wires 93 connected to another electronic device. A wire seal 94 suppressing intrusion of liquid, dust, etc., is disposed on the housing 25 on the side with the wires 93 inserted. The female connector 24 is also disposed with a wire cover 95 to which the wire seal 94 is fixed, and a wire housing 96 covering the wires 93. The female connector 24 of the embodiment is configured with a thick upper side and a thin lower side relative to the portion in which the card member 11 is inserted, so as to enable connection with the card member 11 having the different numbers of the card edge terminals 13 between the top surface 12*a* and the back surface 12*b* as described above. These constituent elements will hereinafter be described.

Figure 8:
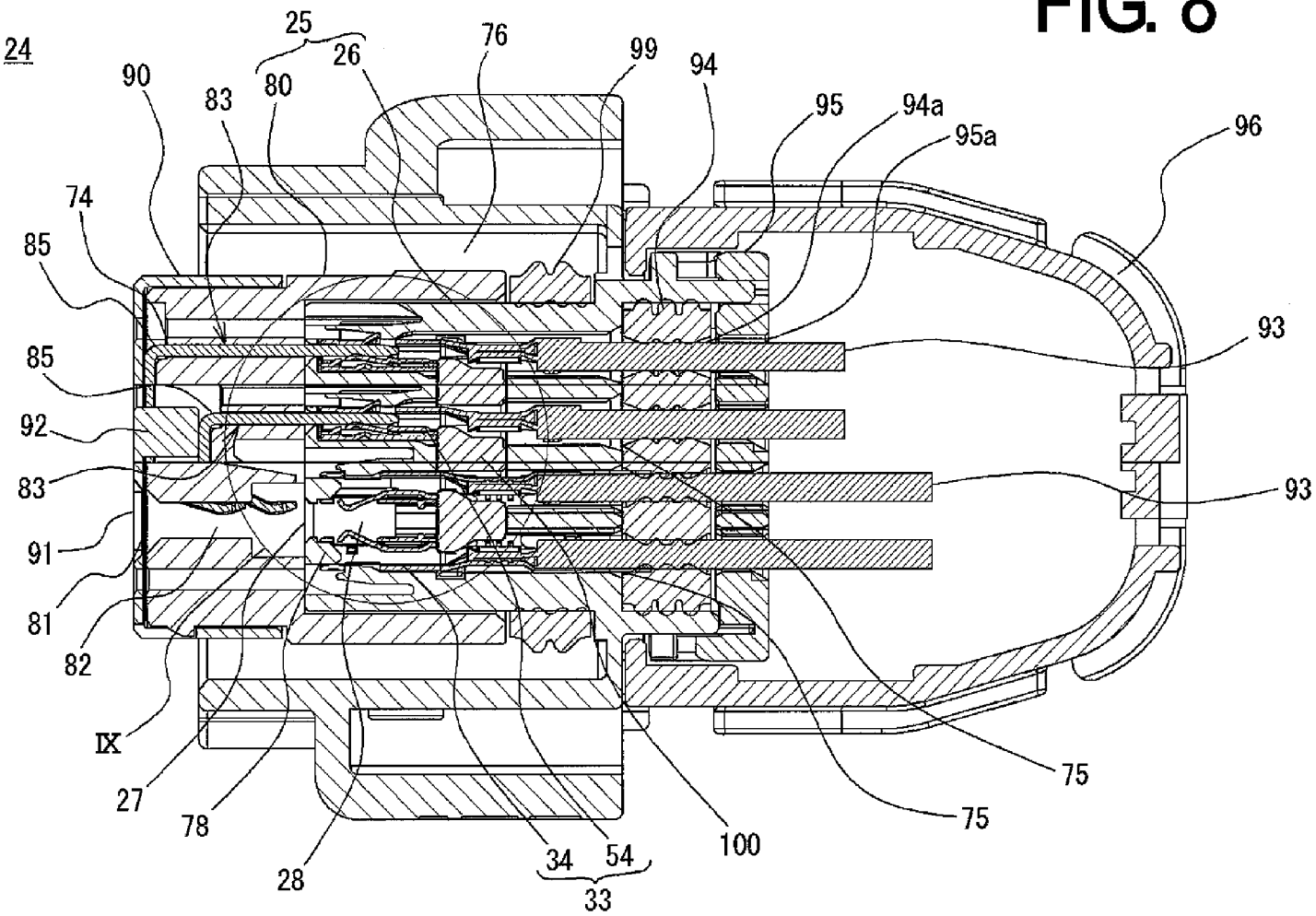
FIG. 8 is a cross-sectional view taken along a line VIII-VIII of FIG. 7A.
Figure 9:
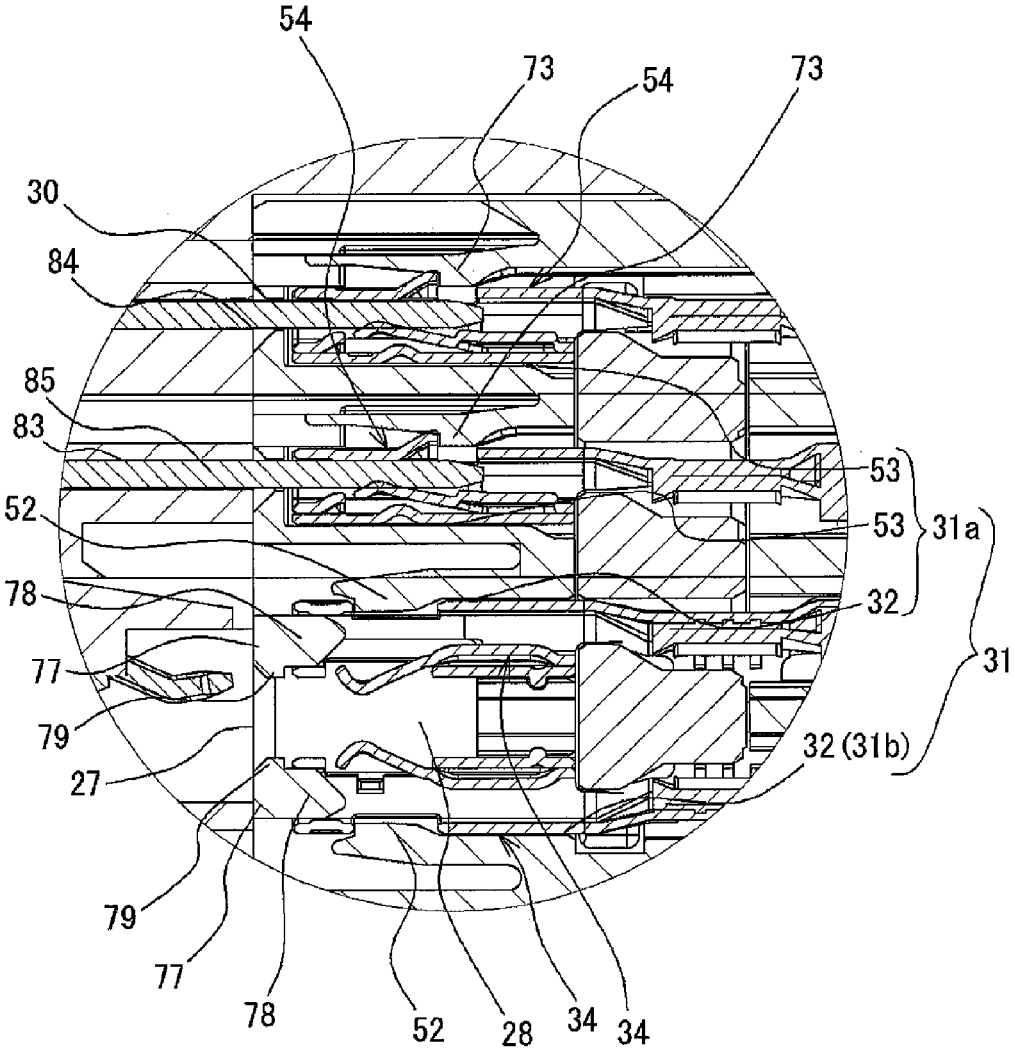
FIG. 9 is an enlarged view of a portion IX of FIG. 8.
Figure 12A:
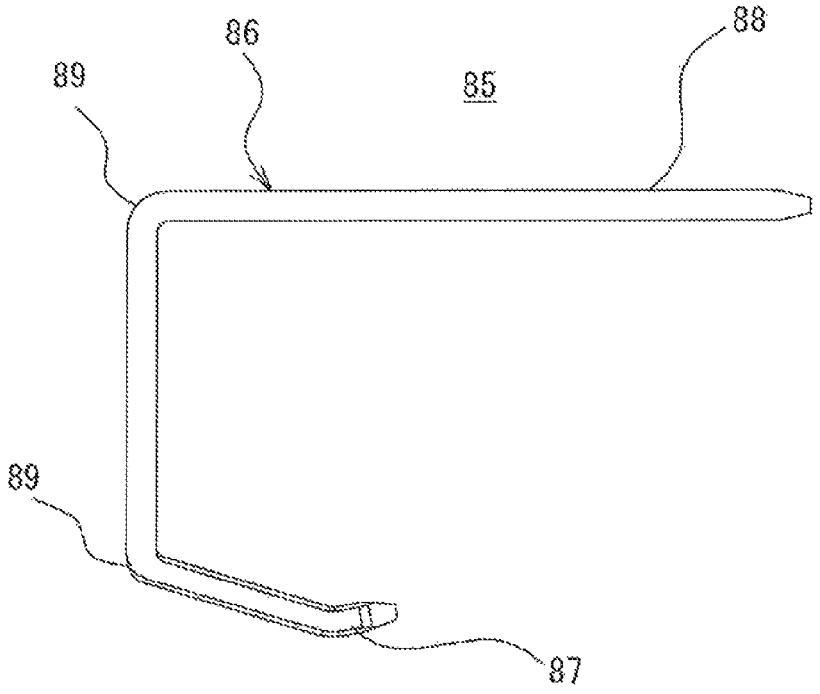
FIG. 12A is a side view of one relay terminal.
Figure 12B:
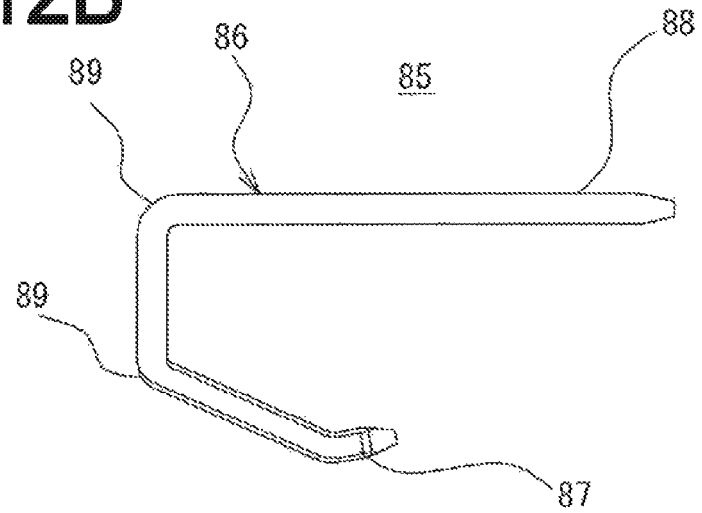
FIG. 12B is a side view of the other relay terminal.

As depicted in FIGS. 8 and 9, the housing 25 of the embodiment is made up of a contact housing 26 provided with the contact housing portions 31 housing the contacts 33, and a relay terminal housing 80 provided with relay terminal housing portions 83 housing the relay terminals 85. The contact housing 26 and the relay terminal housing 80 are detachably attached.

The contact housing 26 is provided with a first flat opening portion 27 in which the card member 11 is inserted on one side and a first inner space 28 in which the card edge portion 14 of the card member 11 is located. The contact housing portion 31 formed in the contact housing 26 has three stages of a first contact housing portion 31*a* formed on the upper side and a stage of a second contact housing portion 31*b* formed on the lower side relative to the first flat opening portion 27 and the first inner space 28 so that the contacts 33 are asymmetrically arranged on the upper side and the lower side.

The first contact housing portion 31*a* is made up of an inner contact housing portion 32 formed on the innermost side relative to the first flat opening portion 27 and the first inner space 28 and outer contact housing portions 53 formed on the outside of the inner contact housing portion 32. On the other hand, the second contact housing portion 31*b* is made up of an inner contact housing portion 32 formed on the innermost side relative to the first flat opening portion 27 and the first inner space 28. The inner contact housing portion 32 houses first contacts 34 described later and the outer contact housing portion 53 houses second contacts 54. The respective inner contact housing portions 32 of the first contact housing portion 31*a* and the second contact housing portion 31*b* are disposed oppositely to each other.

The contact housing 26 is disposed with an insertion port 75 in which a plurality of the wires 93 connected to the first contacts 34 and the second contacts 54 is inserted, on the side of the contact housing 26 opposite to the first flat opening portion 27. The insertion port 75 side of the contact housing 26 is disposed with the wire seal 94 suppressing intrusion of liquid, dust, etc., from the insertion port 75 and also having an effect of retaining the wires 93, and a wire cover 95 fixing the wire seal 94 is disposed outside the wire seal 94. A plurality of open holes 94*a* and 95*a* is formed in the wire seal 94 and the wire cover 95 so that the wires 93 are inserted therethrough.

The inner contact housing portion 32 of the contact housing 26 has side wall portions (not depicted) formed at positions corresponding to the side surfaces 40, 41 (see FIG. 10A) of the housed first contacts 34. The inner contact housing portion 32 has end wall portions 77 on the first flat opening portion 27 side of the contact housing 26.

The inner contact housing portion 32 is formed such that the housed first contacts 34 are surrounded by the side wall portions and the end wall portions 77. The end wall portions 77 of the inner contact housing portion 32 are formed by integrally linking the respective end wall portions 77 on the upper side and the lower side facing across the first flat opening portion 27. Since the end wall portions are integrally formed, the end wall portions can firmly formed.

The end wall portion 77 on the inner contact housing portion 32 side has a projecting portion 78 of a predetermined length formed correspondingly to the housed first contact 34. The projecting portion 78 is a portion coupled to the first contact 34. A shape of the projecting portion 78 is formed into a column shape or a prismatic shape and may be formed correspondingly to the shape of the first contact.

A convex portion 79 is formed on the first flat opening portion 27 side of the end wall portion 77 on the upper side and the lower side of the inner contact housing portion 32. The convex portion 79 has a taper formed such that the card edge portion 14 of the card member 11 can smoothly be guided to the first inner space 28 at the time of insertion. In this case, the convex portion 79 of the end wall portion 77 acts as a wall for the first contact 34 placed on the entry side of the card edge portion 14 to restrain the contact between a leading end of the card edge portion 14 and an end portion of the first contact 34, thereby suppressing damage of the card edge portion 14.

The respective inner contact housing portions 32 on the side of insertion of the card edge portion 14 are at least partially opened so that the housed first contacts 34 can be connected to the card edge terminals 13. An inner locking projection 52 locked with the housed first contact 34 is formed on the side opposite to the open side of the inner contact housing portion 32.

On the other hand, the outer contact housing portion 53 is formed such that the circumference of the housed second contact 54 is surrounded, and an outer locking projection 73 locked with the housed second contact 54 is formed on the upper surface side of the outer contact housing portion 53.

The outer contact housing portion 53 has an opening portion 30 formed on the relay terminal housing 80 side and communicating with the relay terminal housing portion 83 formed in the relay terminal housing 80. The relay terminal 85 is inserted through the opening portion 30 and coupled to the second contact 54.

Figure 7A:
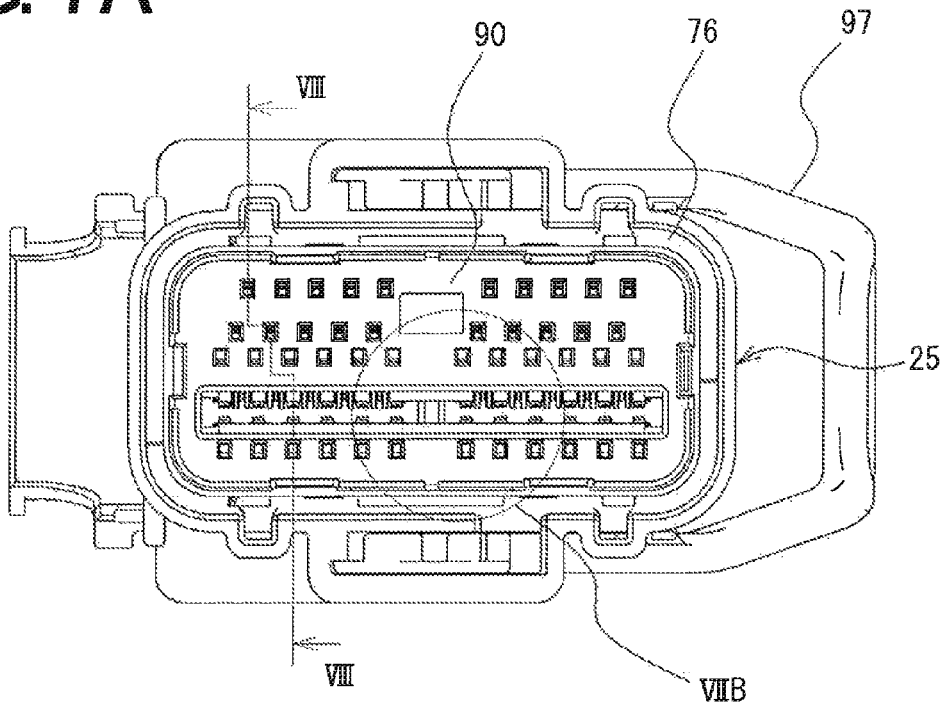
FIG. 7A is a front view of the female connector.
Figure 7B:
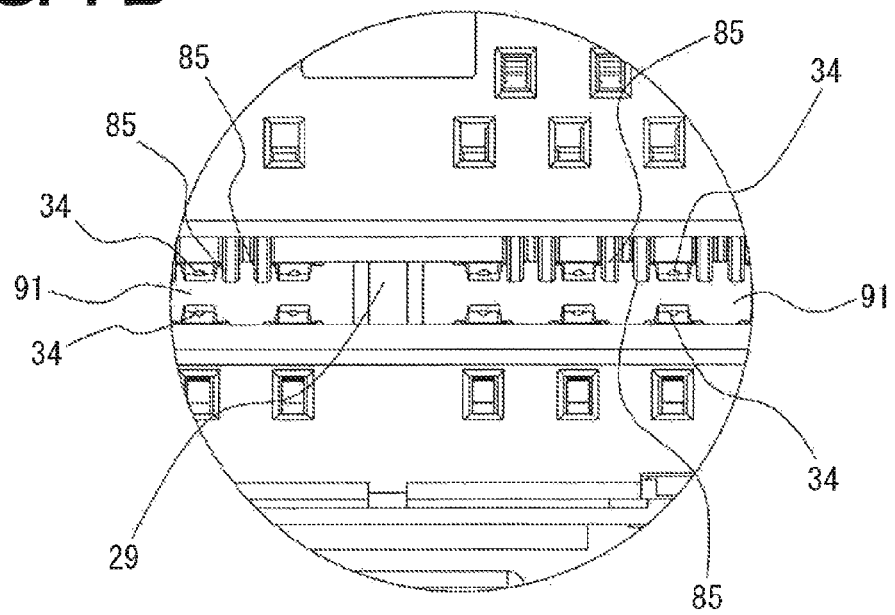
FIG. 7B is an enlarged view of a portion VIIB of FIG. 7A.

As depicted in FIGS. 7A and 7B, a rib 29 linking the upper side and the lower side of the first inner space 28 is formed in the first inner space 28 of the contact housing 26 in parallel with the direction of insertion of the card member 11 from the first flat opening portion 27 toward the inside of the first inner space 28. The rib 29 is fit into the slit 15 formed in the substrate of the card member and the card edge terminals can accurately be brought into contact with the first contacts and the relay terminals coupled to the second contacts by fitting the rib 29 into the slit 15.

Since the rib 29 is formed, the first flat opening portion 27 and the first inner space 28 can be restrained from deforming even if the first flat opening portion 27 of the contact housing 26 is formed with a long opening width. The ribs 29 may be formed at a plurality of positions. The rib may be formed not only on the contact housing but also on the relay terminal housing. If the rib is formed on the relay terminal housing, the rib is formed at a position corresponding to the rib formed on the contact housing.

As depicted in FIGS. 8 and 9, the relay terminal housing 80 has a second flat opening portion 81 in which the card member 11 is inserted on one side and a second inner space 82 in which the card edge portion 14 of the card member 11 is located and the relay terminal housing portion 83 is formed above the second flat opening portion 81 and the second inner space 82. The relay terminal housing portion 83 has a inserting portion 74 formed to insert the relay terminal 85 on one side closer to the second flat opening portion 81 and an opening 84 formed such that the inserted relay terminal 85 is projected on the other side closer to the contact housing 26. The projected relay terminal 85 is mounted on and coupled to the second contact 54 housed in the outer contact housing portion 53 of the contact housing 26. The relay terminal housing portion 83 is formed into a shape corresponding to the shape of the relay terminal 85 such that the relay terminal 85 is positioned when housed.

A lid body 90 is detachably attached to the second flat opening portion 81 side of the relay terminal housing 80 for covering the relay terminal 85 housed in the relay terminal housing portion 83 and fixing the relay terminal 85 to the relay terminal housing portion 83. The lid body 90 is disposed with a pressing portion 92 capable of pressing the relay terminal 85 housed in the relay terminal housing 80 when the lid body is attached to the relay terminal housing 80. The lid body 90 has a third flat opening portion 91 formed at a position corresponding to the second flat opening portion 81 and the card edge portion 14 of the card member 11 is inserted from the third flat opening portion 91.

The contact housing 26 is disposed with a fitting portion 76 fitted to the fitting portion 19 of the card housing 16 attached to the card member 11. The fitting portion 76 is provided with a seal member 99 to prevent formation of a gap with the fitting portion 19 of the card housing 16 when the card member 11 is connected.

The first contact 34 will be described with reference to FIGS. 8 to 10C. The first contact 34 has a first connecting portion 35 directly connected to the card edge terminals 13 on one side and a first wire mounting portion 36 mounted with the wire 93 on the other side, which are integrally made of conductive material. The first contact 34 is formed by press working, bending working, etc., of a punched metal plate body, for example.

The first connecting portion 35 has a first front-side opening 37 disposed on the first flat opening portion 27 side when the first contact 34 is housed in the inner contact housing portion 32 of the contact housing 26, and a first rear-side opening 38 formed on the first wire mounting portion 36 side, and is formed into a hollow cylindrical body made up of a first bottom surface 39, a first side surface 40 on one side, a first side surface 41 on the other side, a first upper surface 42, etc.

The first bottom surface 39 making up the first connecting portion 35 is formed into a rectangular shape having a predetermined area and is orthogonally bent from both end sides parallel to the axial direction of the first bottom surface 39 to form the one first side surface 40 and the other first side surface 41, and the first upper surface 42 is formed by orthogonally bending the one first side surface 40 from the end side opposite to the first bottom surface 39 side. A first contact piece 43 is formed and located on the underside of the first upper surface 42 by orthogonally bending the other first side surface 41 from a portion of the end side opposite to the first bottom surface 39 side closer to the first rear-side opening 38.

The other first side surface 41 has a cutout portion 45 formed by cutting out the other first side surface 41 on the first upper surface 42 side in a portion except a first extending portion 44 from which the first contact piece 43 is extended on the upper portion of the other first side surface 41. The first upper surface 42 is orthogonally bent from the end side on the other first side surface 41 side to form a short side surface 46 formed into a size corresponding to the cutout portion 45 and the short side surface 46 closes the cutout portion 45. The first connecting portion 35 is formed into a hollow cylindrical body with such a configuration. As described above, by bending one plate-like body to integrally form the first contact 34, the first contact 34 can efficiently and firmly be formed.

The first contact piece 43 is formed into a curved plate-like body and is integrally made up of a first contacting portion 47 brought into contact with the card edge terminal 13 on one side and the first extending portion 44 linked to the other first side surface 41 on the other side. A first opening hole 48 is formed in the first upper surface 42 and the first contacting portion 47 disposed on the first contact piece 43 is located to project from the first opening hole 48.

As a result, when the card member 11 is attached/detached, the first contacting portion 47 is pressed and moved by the card edge terminal 13 and elastically deformed up and down based on the first extending portion 44 in the first connecting portion 35 and sufficient contact pressure can be acquired even when the card edge portion 14 is distorted.

A first locking hole 49 is formed on the first bottom surface 39 of the first contact 34 and can be locked with the inner locking projection 52 formed on the inner contact housing portion 32 of the contact housing 26. A first regulating portion 50 regulating a movable range of the first contact piece 43 pushed down by connection with the card member 11 is formed on the one first side surface 40 side of the first contact 34 by bending a portion of the one first side surface 40. Since the deformation of the first contacting portion 47 of the first contact 34 can be defined within a certain range by forming the first regulating portion 50, the weakening of contact pressure can be suppressed between the card edge terminal 13 and the first contact 34.

On the other hand, while the wire 93 is not mounted, the first wire mounting portion 36 has piece portions 51 on the both sides formed upward as depicted in FIG. 10A and, when the wire 93 is mounted, the piece portions 51 on the both sides are folded to pinch the wire 93 for mounting the first contact 34 and the wire 93.

In the description of the first contact 34, the vertical and horizontal directions are described by using the directions depicted in FIGS. 10A to 10C as a reference. Therefore, if the first contact 34 is attached upside down relative to the state depicted in FIGS. 10A to 10C, the first bottom surface 39 is located on the upper side (see FIG. 8).

The second contact 54 will be described with reference to FIGS. 8, 9, and 11A to 11C. The second contacts 54 has a coupling portion 5 for inserting and coupling the relay terminal 85 on one side and a second wire mounting portion 56 mounted with the wire 93 on the other side, which are integrally made of conductive material. The second contact 54 is formed by press working, bending working, etc., of a punched metal plate body, for example.

The coupling portion 55 has a second front-side opening 58 disposed on the first flat opening portion 27 side when the second contact 54 is mounted on the outer contact housing portion 53 of the contact housing 26, and a second rear-side opening 59 formed on the second wire mounting portion 56 side, and is formed into a hollow cylindrical body made up of a second bottom surface 60, a second side surface 62 on one side, a second side surface 63 on the other side, a second upper surface 65, etc.

The second bottom surface 60 making up the coupling portion 55 is formed into a rectangular shape having a predetermined area and is orthogonally bent from both end sides parallel to the axial direction of the second bottom surface 60 to form the one second side surface 62 and the other second side surface 63. The second upper surface 65 is formed by orthogonally bending the one second side surface 62 from the end side opposite to the second bottom surface 60 side. A second contact piece 67 is extended and located inside the coupling portion 50 on the underside of the second upper surface 65 by orthogonally bending the other second side surface 63 from a portion of the end side opposite to the second bottom surface 60 side closer to the second rear-side opening 59.

A second contacting portion 69 brought into contact with the relay terminal 85 is formed on the second contact piece 67 on the side opposite to a second extending portion 68 connected to the other second side surface 63. A short plate body 71 is disposed under the second upper surface 65 on the second front-side opening 58 side by extending and bending the other second side surface. The short plate body 71 is disposed with a bending portion 72 formed to project toward the back of the coupling portion 55 with a gradually increasing height. Since the bending portion 72 is formed, the relay terminal 85 is guided in the coupling portion 55 and smoothly led to the second contacting portion 69 of the second contact piece 67.

A second locking portion 70 is opened in the second bottom surface 60 of the second contact 54 and a projecting portion 61 is formed to project on the second front-side opening 58 side of the second locking portion 70. The second locking portion 70 is a portion locked with the outer locking projection 73 formed on the outer contact housing portion 53, and the projecting portion 61 is a portion brought into contact with the leading end of the outer locking projection 73 to position the second contact 54.

A second regulating portion 66 regulating a movable range of the second contact piece 67 pushed down by coupling of a coupling piece 88 of the relay terminal 85 is formed on the second upper surface 65 side of the second contact 54 to project toward the inside of the coupling portion 55. Since the deformation of the second contacting portion 69 of the second contact 54 can be defined within a certain range by forming the second regulating portion 66, the weakening of contact pressure can be suppressed between the relay terminal 85 and the second contact 54.

On the other hand, as depicted in FIG. 11A, while the wire 93 is mounted, piece portions 57 on the both sides of the second wire mounting portion 56 are folded to pinch the wire 93 for mounting the second contact 54 and the wire 93.

In the description of the second contact 54, the directions depicted in FIGS. 11A to 11C are used as a reference. Therefore, since the second contact 54 is attached upside down relative to the state depicted in FIGS. 11A to 11C, the second bottom surface 60 is located on the upper side (see FIG. 8).

The relay terminal 85 will be described with reference to FIGS. 8, 9, 12A, and 12B. The relay terminal 85 is disposed with a relay terminal main body 86 having a bending portion 89 formed at least at one location by bending an elongated plate-like body of conductive material at a predetermined angle, a second connecting portion 87 connected to the card edge terminal 13 on one side of the relay terminal main body 86, and the coupling piece 88 coupled to the coupling portion 55 of the second contact 54 on the other side. The number of bending portions may be changed in accordance with a structure used.

The second connecting portion 87 is configured to be movable upward and downward at the time of connection with the card edge terminal 13 after the relay terminal 85 is coupled to the second contact 54 and disposed in the relay terminal housing portion 83, and is formed to be elastically deformable around the bending portion 89 that has been bent.

The coupling piece 88 is formed into a plate-like body somewhat close to a prismatic shape so as to acquire a high coupling force for coupling to the coupling portion 55 of the second contact 54. The coupling piece 88 is a portion electrically connected to the second contact piece 67 in the coupling portion 55 of the second contact 54.

The first contact 34 and the second contact 54 are fixed within the inner contact housing portion 32 and the outer contact housing portion 53 by mounting a retainer 100 on the contact housing 26 (see FIGS. 8 and 9).

Figure 6:
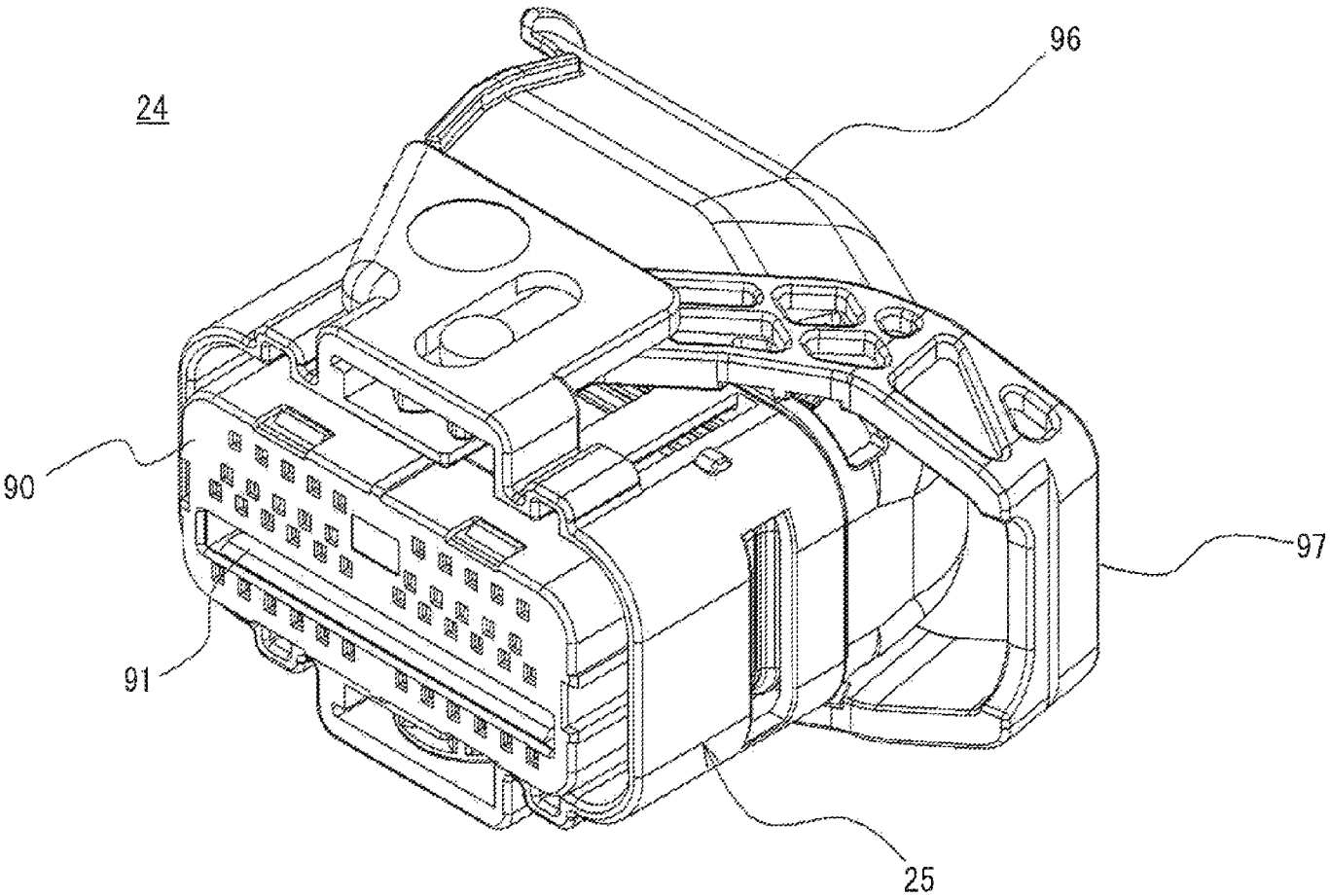
FIG. 6 is a perspective view of a female connector of the embodiment.

As depicted in FIGS. 1 and 6, the contact housing 26 is provided with a wire housing 96 partially covering the wires 96 inserted through the insertion port 75 so that the wires 93 can be directed toward an arbitrary direction. The wire housing 96 is provided with a lock lever 97 fixed to the lock portion 22 formed on the card housing 16 when connected to the card housing 16 of the card member 11. The lock mechanism 98 is made up of the lock portion 22 of the card housing 16 and the lock lever 97 of the wire housing 96. The lock mechanism is a known mechanism and therefore will not be described in detail.

Figure 13:
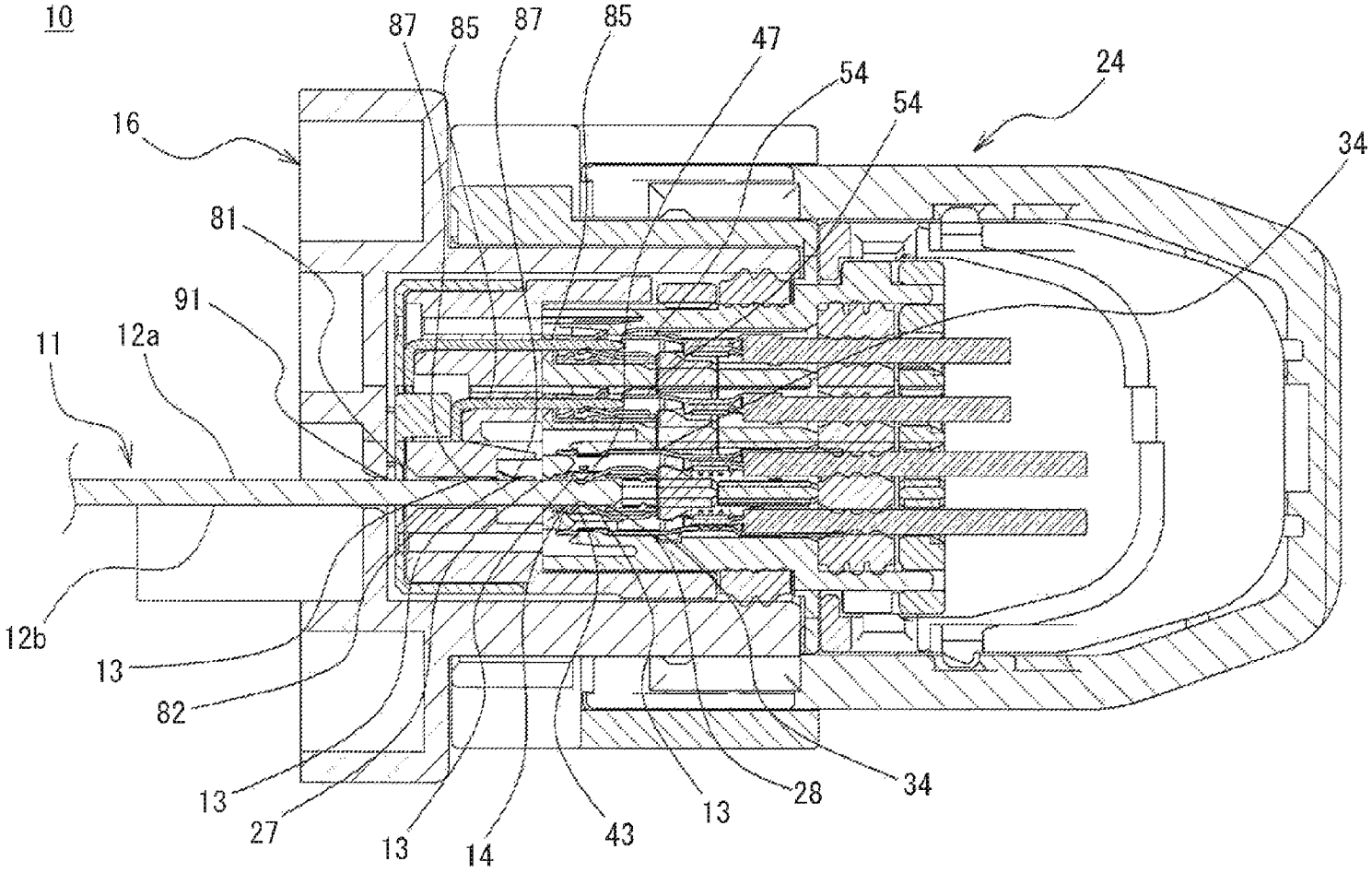
FIG. 13 is a cross-sectional view taken along a line XIII-XIII of FIG. 1.

The connection of the card edge connector 10 will be described with reference to FIG. 13. The card member 11 of the embodiment has a larger number of the card edge terminals 13 formed in multiple rows on the top surface 12*a* and a smaller number of the card edge terminals 13 formed in a row on the back surface 12*b* as described above. On the other hand, the female connector 24 of the embodiment is connected to the card member having the card edge terminals 13 formed asymmetrically on the top surface and the back surface in this way and therefore is provided with multiple stages of contacts on the upper stage and a row of contacts on the lower stage across the portion connected with the card member 11.

The card edge connector 10 is connected by inserting the card edge terminals 13 of the card member 11 from the third flat opening portion 91 of the lid body 90 of the female connector 24. The card edge terminals 13 are then allowed to pass through the second flat opening portion 81 and the second inner space 82 of the relay terminal housing 80, and the first flat opening portion 27 and the first inner space 28 of the contact housing 26 such that the card edge portion 14 is located in the first inner space 28 and the second inner space 82.

In this case, the first contacting portions 47 of the first contacts 34 come into direct contact with the card edge terminals 13 of the top surface 12*a* and the back surface 12*b* formed in the endmost portion of the card edge portion 14 of the card member 11 in the first inner space 28 of the contact housing 26. The second connecting portions 87 of the relay terminals 85 coupled to the second contacts 54 respectively come into contact with the card edge terminals 13 formed into the multiple rows on the inner side of the top surface 12*a* out of the card edge terminals 13 in the second inner space 82 of the relay terminal housing 80. By operating the lock lever 97 of the lock mechanism 98 to fix the card member 11 and the female connector 24, the connection of the card edge connector 10 consisting of the card member 11 and the female connector 24 is completed.

The card edge connector of the embodiment can provide the card member making up the card edge connector with a space usable for another purpose on one side by making a difference in circuit wiring between a top surface and a back surface. The female connector is provided with multiple stages of contacts on the side connected to the top surface of the substrate of the card member and with a stage of contacts on the side connected to the back surface of the substrate so that the female connector can be connected to the card member with such a space efficiently utilized.

Although the housing is divided into the contact housing and the relay terminal housing in the description of the embodiment, this is not a limitation and the contact housing and the relay terminal housing may be integrally formed as one housing. Although the lid body is disposed on the relay terminal housing in the description of the embodiment, this is not a limitation and the lid body may not be disposed. As a result, the number of components can be reduced and assembly work can be simplified.

The card edge terminals formed on the substrate can be gold-plated. All the card edge terminals may be gold-plated or an arbitrary portion may be gold-plated. The gold-plating can improve the conductive property. The contacts brought into contact with the gold-plated card edge terminals may preferably be gold-plated.

Although the signal circuit is formed on the top surface and the power circuit is formed on the back surface in the description of the substrate of the embodiment, this is not a limitation and the signal circuits may be formed on the both sides such that the numbers of the card edge terminals become asymmetric. As a result, the range of design of the substrate can be expanded.

What is claimed is:

1. A female connector, comprising: a housing disposed with a plurality of contacts to be connected to a card member having a card edge portion with a plurality of card edge terminals formed on a substrate, wherein the housing includes contact housing portions that house the contacts, the housing having a flat opening portion into which the card edge portion is inserted on one side, an insertion port through which a wire is inserted on the other side, and an inner space therein, the inner space communicating with the flat opening portion and acting as a portion in which the card edge portion is located, the contact housing portions are arranged as at least two stages of first contact housing portions formed on one side relative to the inner space of the housing, the first contact housing portions communicating with the insertion port, and one stage of second contact housing portions formed on the other side relative to the inner space of the housing, the second contact housing portions communicating with the insertion port, wherein the first contact housing portions are made up of inner contact housing portions disposed adjacently to the inner space and at least one stage of outer contact housing portions disposed on the outside of the inner contact housing portions, the second contact housing portions are made up of another inner contact housing portions disposed adjacently to the inner space, the respective inner contact housing portions of the first contact housing portions and the another inner contact housing portions of the second contact housing portions are disposed oppositely to each other, the inner contact housing portions house first contacts to be directly connected to the card edger terminals while the outer contact housing portions house second contacts, the second contacts are coupled to relay terminals made of conductive material, and the relay terminals are extended in the inner space to be connected to the card edge terminals.

2. The female connector of claim 1, wherein the first contact housing portions are formed on three stages.

3. The female connector of claim 1, wherein the housing has relay terminal housing portions formed to be in communication with the outer contact housing portions, and the relay terminal housing portions house the relay terminals.

4. The female connector of claim 3, wherein the housing is divided into a contact housing on the side disposed with the contact housing portions and a relay terminal housing on the side disposed with the relay terminal housing portions, and the contact housing and the relay terminal housing are detachably connected.

5. The female connector of claim 4, wherein the first contact has a first connecting portion connected to the card edge terminal on one side formed integrally with a first wire mounting portion mounted with the wire on the other side, the first connecting portion is formed into a hollow cylindrical body having a first front-side opening formed on the inner space side of the contact housing when the first contact is attached to the inner contact housing portion, a first rear-side opening formed on the first wire mounting portion side, and a first contacting portion brought into contact with the card edge terminal, the inner contact housing portion of the contact housing is covered by side wall portions formed on the sides of both side surfaces of the housed first contact and an end wall portion formed on the first front-side opening side, the first contact is opened at least at a portion provided with the first contacting portion, and a protruding portion fitted into the first front-side opening of the first connecting portion is formed on the side of the end wall portion opposite to the first contact.

6. The female connector of claim 5, wherein the end wall portions formed in the contact housing are formed to be respectively integrally linked on one side and the other side across the inner space of the contact housing.

7. The female connector of claim 4, wherein the second contact has on one side a coupling portion to which the relay terminal is inserted and coupled and formed integrally with a second wire mounting portion to be mounted with the wire on the other side, the coupling portion formed into a hollow cylindrical body having a second front-side opening formed on the flat opening portion side when the second contact is attached to the relay terminal housing, and a second rear-side opening formed on the second wire mounting portion side, and a second contacting portion is disposed inside the coupling portion and brought into contact with a portion of the relay terminal when the relay terminal is coupled.

8. The female connector of claim 1, wherein the housing has at least one rib formed to link the upper side and the lower side of the inner space.

9. The female connector of claim 1, wherein the housing is mounted with a lid body covering the relay terminals and having an opening at least at a portion corresponding to the flat opening portion, and the lid body has a pressing portion pressing, positioning, and fixing a portion of the relay terminals.

10. The female connector of claim 1, wherein the relay terminal has a relay terminal main body made up of a bent plate-like body, a second connecting portion formed on one side of the relay terminal main body and connected to the card edge terminal, and a coupling piece inserted from the second front-side opening of the coupling portion which is formed on the other side of the relay terminal main body, coupled in the coupling portion of the second contact, and brought into contact with the second contacting portion in the coupling portion.

11. A card edge connector, comprising:

a card member to be connected to a female connector including: a housing disposed with a plurality of contacts to be connected to the card member having a card edge portion with a plurality of card edge terminals formed on a substrate, wherein the housing includes contact housing portions that house the contacts; the housing having a flat opening portion into which the card edge portion is inserted on one side, an insertion port through which a wire is inserted on the other side, and an inner space therein, the inner space communicating with the flat opening portion and acting as a portion in which the card edge portion is located; the contact housing portions are arranged as at least two stages of first contact housing portions formed on one side relative to the inner space of the housing, the first contact housing portions communicating with the insertion port, and one stage of second contact housing portions formed on the other side relative to the inner space of the housing, the second contact housing portions communicating with the insertion port; and the substrate having at least two rows of card edge terminals on one surface of the substrate and one row of card edge terminals on the other surface thereof, the card edge portion having a slit disposed at least at one location.

12. The card edge connector of claim 11, wherein the card member includes a card housing to be connected to the housing of the female connector, the card housing has a substrate insertion hole formed at a position corresponding to the flat opening portion of the female connector, and the card edge portion of the card member is projected from the substrate insertion hole.

13. The card edge connector of claim 12, wherein the female connector is disposed with a lock mechanism fixing the state of connection to the card housing.

14. The card edge connector of claim 11, wherein the card housing is disposed with an annular fitting portion covering the projected card edge portion.

15. The card edge connector of claim 11, wherein the substrate of the card member has a mounting portion mounted on one side and has a power source wiring for a power source disposed on the other side, and a cooling member is disposed on the side disposed with the power source wiring.

* * * * *